United States Patent [19]

Friedson

[11] Patent Number: 4,502,266

[45] Date of Patent: Mar. 5, 1985

[54] RIDING SADDLE CONSTRUCTION

[76] Inventor: Ronald S. Friedson, 95 Bayberry La., Westport, Conn. 06880

[21] Appl. No.: 539,843

[22] Filed: Oct. 7, 1983

[51] Int. Cl.[3] ..... B68C 1/00

[52] U.S. Cl. ..... 54/44; 54/46

[58] Field of Search ..... 54/23, 37, 44, 46

[56] References Cited

U.S. PATENT DOCUMENTS

| | | | |
|---|---|---|---|
| 28,867 | 6/1860 | Jenifer | 54/44 |
| 862,572 | 8/1907 | Maussner | 54/44 |
| 2,239,764 | 4/1941 | Vordemberge | 54/23 |
| 2,474,953 | 7/1949 | Mock et al. | 54/46 |
| 3,234,711 | 2/1966 | Jamieson | 54/46 |
| 3,638,395 | 2/1972 | Reidhead | 54/46 |
| 3,641,739 | 2/1972 | Stubben | 54/46 |

FOREIGN PATENT DOCUMENTS

| | | | |
|---|---|---|---|
| 4222 | of 1899 | United Kingdom | 54/46 |

*Primary Examiner*—Robert P. Swiatek

*Attorney, Agent, or Firm*—Mattern, Ware, Stoltz & Fressola

[57] ABSTRACT

The present invention achieves a unique riding saddle construction which provides a substantial reduction in the bulk of conventional saddles by securely mounting elongated, substantially continuous webbing along the side flaps to protrude beyond the lower edge of the side flaps. The billet straps are then securely mounted to the extension portion of the webbing. In the preferred construction, the elongated length of webbing is sandwiched between the two layers which forms the side flap and is secured at one end to the saddle tree. The present invention achieves a unique, compact saddle construction with substantially reduced bulk, while providing substantially easier and less expensive upkeep and maintenance requirements.

14 Claims, 3 Drawing Figures

FIG. 1
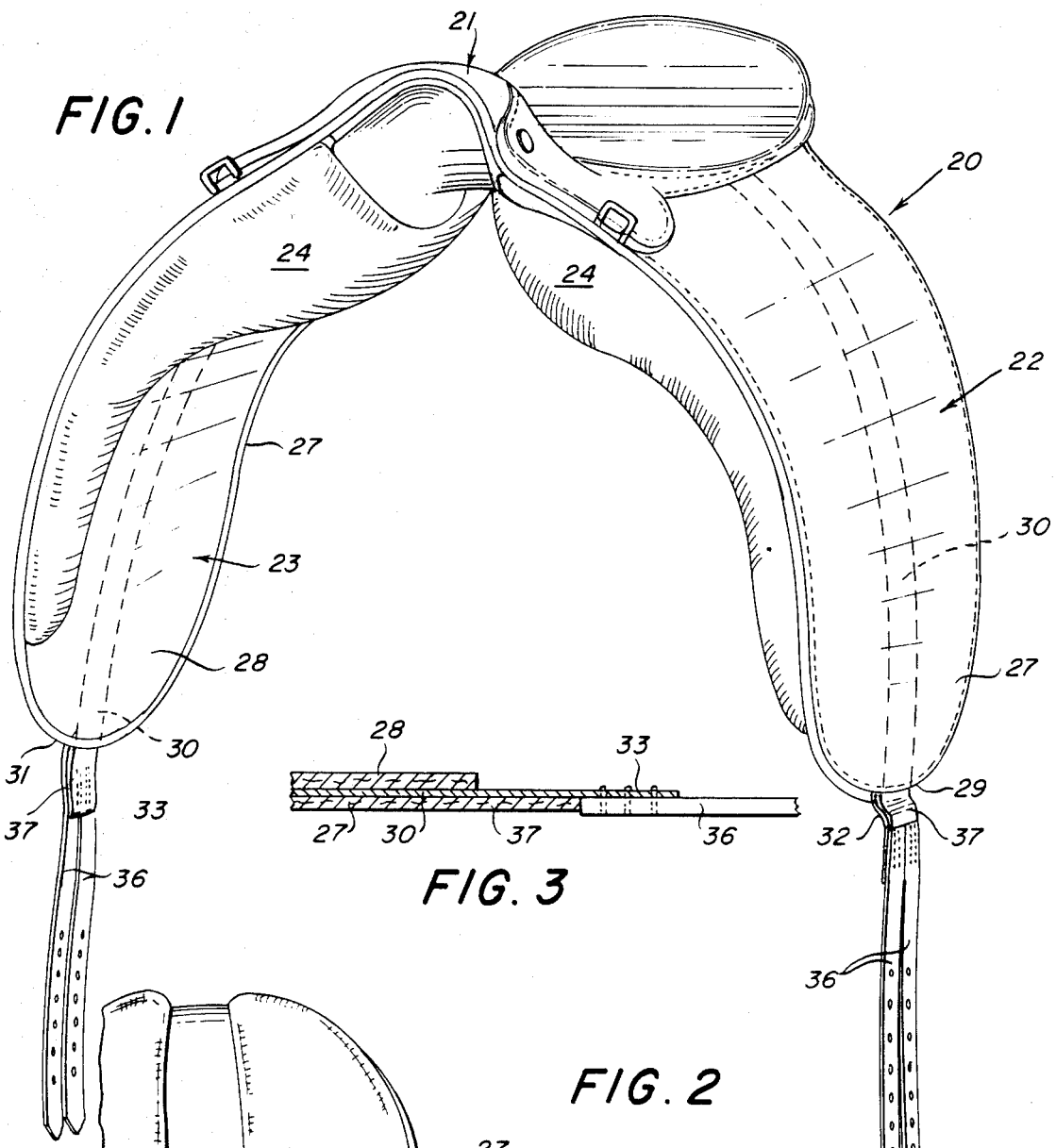
FIG. 3
FIG. 2
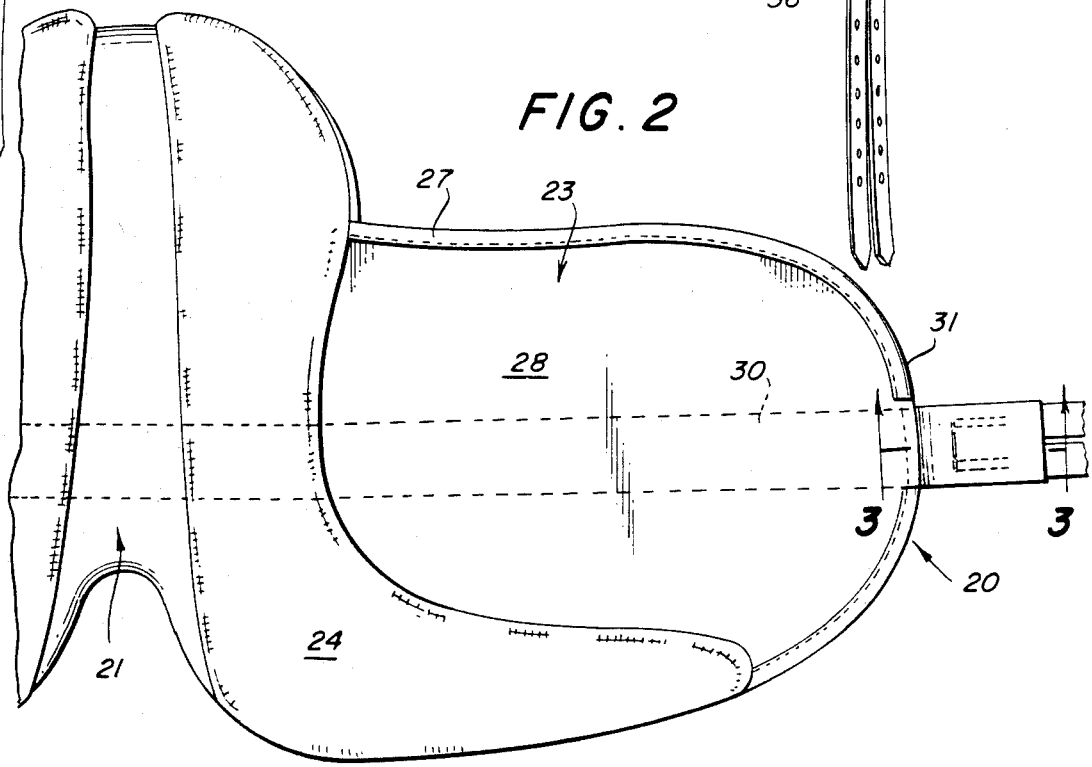

RIDING SADDLE CONSTRUCTION

TECHNICAL FIELD

This invention relates to riding saddles and more particularly to the construction of saddle billets and side flaps.

BACKGROUND ART

Through the many years during which saddles have been employed, most major changes in saddles have been in their design and appearance. However, no substantial change has been made in the basic saddle construction. As a result, the basic saddle construction suffers from various problems and difficulties which have heretofore been unresolved.

In particular, conventional saddles incorporate a side flap or skirt which extends from the central frame or tree on both sides thereof. In addition, a sweat flap or underskirt is also secured to the saddle tree, extending downwardly therefrom below the side flap or skirt. Billet straps are also securely mounted to the saddle tree and extend downwardly therefrom between the sweat flap and the side flaps.

As a result of this construction, a rider's legs are spaced away from the horse's side, a substantial distance, due to the thick, bulky, layers formed by the sweat flaps, billet straps and side flaps. This bulk has been found to be extremely undesirable, since the sensitivity of the horse's side to the rider's leg movements and commands are reduced.

In addition, conventional saddle construction also requires a rider to form these plurality of layers to the shape of the horse's side before any leg commands can be felt by the horse with any degree of responsiveness. Consequently, the rider is forced to expend extra effort in forming the leather layers to the shape of the horse before being able to provide the horse with the desired commands.

Furthermore, this conventional construction is extremely expensive, not only in the cost of the original saddle, but also in the maintenance and upkeep of the saddle. The most susceptible portion of the saddle to wear and need replacement is the elongated billet straps which extend from the saddle tree between the sweat flap and the side flaps. Since these elongated straps are free to be moved and flex, the straps tend to twist, turn and rub against each other as well as the saddle flaps. This constant movement causes the straps to wear.

When replacement of these straps is required, a substantial expense is incurred. This expense is typically incurred since the straps must be replaced in their entirety, and the saddle must be disassembled in order to remove and replace the straps.

In addition, conventional saddle construction also causes difficulty in the saddle slipping or twisting during use. This slippage or twist usually occurs due to the construction of the elongated billet straps which hang loosely from the saddle tree. As a result, the straps are very susceptible to movement which causes slippage or twisting of the saddle, as well as the straps themselves.

Therefore, it is a principal object of the present invention to provide a saddle construction, wherein the bulk of conventional saddles is substantially reduced.

Another object of the present invention is to provide a saddle construction having the characteristic features described above, wherein the elongated billet straps are completely eliminated and removal and replacement of the billet straps, upon wear, is achieved easily and economically.

Another object of the present invention is to provide a saddle construction having the characteristic features described above, wherein saddle slippage or twisting is substantially eliminated, along with the substantial elimination of all twisting and turning of the billet straps.

Another object of the present invention is to provide a saddle construction having the characteristic features described above, wherein billet strap wear between the saddle tree and the terminating edge of the saddle flaps is completely eliminated.

Another object of the present invention is to provide a saddle construction having the characteristic features describe above, wherein twisting or dislocation of the side flaps is substantially eliminated.

Other and more specific objects will in part be obvious and will in part appear hereinafter.

SUMMARY OF THE INVENTION

The present invention overcomes the prior art drawbacks and difficulties and establishes a new, innovative saddle construction by employing an elongated, substantially continuous webbing of high strength material which is mounted to the saddle tree, as well as being securely mounted along the side flaps of the saddle. In addition, the elongated webbing extends beyond the terminating lower edge of the side flaps, establishing a webbing extension portion to which billet straps are directly mounted.

By employing the saddle construction of the present invention, only short, easily replaced billet straps are used and a substantially improved and enhanced billet strap configuration is attained since a major portion of the effective length of the billet strap is provided by the continuous, elongated webbing which extends from the short ends of the billet straps to the saddle tree. Furthermore, with the continuous, elongated webbing securely mounted to the side flaps of the saddle, twisting, turning or wear is eliminated.

In the preferred construction, the elongated, substantially continuous webbing is mounted in sandwiched engagement between the two leather layers forming the side flaps. With this construction, not only is twisting, turning, and slippage of the saddle and the billet straps eliminated, but the necessity for a sweat flap is also completely eliminated. Consequently, only a single side flap and a comparatively thin elongated webbing material exits between the rider's legs and the side of the horse. As a result, the horse's sensitivity to the rider's leg commands is substantially improved, as well as providing greater comfort and control for the rider.

Although any type of high strength webbing material can be employed in carrying out the present invention, as well as any desired size and shape of webbing, it has been found that a substantially continuous, elongated strip of nylon having an overall width of between about one inch and four inches is desirable. The optimum width has been found to be about two inches.

In order to provide the desired saddle securement capability, the strip of nylon webbing should be secured to the saddle tree. However, this tree securement may be achieved in various alternative ways. In one embodiment, the webbing comprises a single, continuous, elongated strip which extends from the bottom of one side flap around the saddle tree and down the second side flap. Alternatively, two independent webbing strips can be mounted directly to the tree and extend in opposite directions therefrom to the lower edge of each side flap, with the extension portion protruding from the lower edge of each side flap. In addition, any conventional method for fastening billets to the saddle tree can be employed to securely fasten the webbing to the saddle tree.

The invention accordingly comprises a product possessing the features, properties and relation of components which will be exemplified in the product hereinafter described, and the scope of the invention will be indicated in the claims.

THE DRAWINGS

For a fuller understanding of the nature and objects of the invention, reference should be had to the following detailed description taken in connection with the accompanying drawings, in which:

FIG. 1 is a perspective view of the saddle construction of the present invention;

FIG. 2 is a bottom plan view, partially broken away, of the saddle of FIG. 1; and FIG. 3 is a cross-sectional elevation view taken along line 3—3 of the FIG. 2.

BEST MODE FOR CARRYING OUT THE INVENTION

In FIGS. 1 and 2, saddle 20 is shown incorporating the unique construction of the present invention. As will be readily apparent from the following detailed disclosure, the saddle construction of this invention can be incorporated into any type of saddle, whether the saddle be a western style or english style. The saddle construction shown in the Figures represents an english style saddle, but this representation is for illustration purposes only and not intended in any way as a limitation.

Saddle 20 incorporates a frame or tree portion 21 which is covered with leather. Extending from tree portion 21 on both sides thereof are side flaps or skirts 22 and 23. In addition, padded areas 24 are also formed on the inside surface of flaps 22 and 23, in order to provide cushioning between the rider and the horse.

In the saddle construction of the present invention, side flaps 22 and 23 are each constructed, in their preferred embodiment, from two, substantially continuous layers of material 27 and 28. Preferably, layers 27 and 28 are securely mounted to each other by stitching the terminating edges of the layers to each other. In addition, layers 27 and 28 are preferably formed from leather or suede. As shown in FIG. 1, layer 27 forms the outer surface of side flap 22 and 23, while layer 28 forms the inside surface of flaps 22 and 23.

In the preferred embodiment of the present invention, an elongated, substantially continuous strip of webbing 30 is mounted between layers 27 and 28 of flaps 22 and 23. By employing elongated, substantially continuous web 30, the requirement for conventional long billet straps is completely eliminated and the undesirable twisting, turning and wear of conventional billet straps from their repeated movement is similarly eliminated. By employing the teaching of the present invention, there is no separate strap extending from the saddle tree along the inside surface of the side flaps. As result, the necessity for a sweat flap is also eliminated, as shown in FIGS. 1 and 2.

In carrying out the teaching of the present invention, webbing 30 may comprise any desired size and shape and may be mounted in a plurality of alternate ways. In one construction, as shown in FIGS. 1 and 2, webbing 30 comprises a single, continuous elongated strip which extends at least from the terminating edge 29 of side flap 22 upwardly between layers 27 and 28 to saddle tree 21, to which it is secured in a conventional manner, and then extends from saddle tree 21 downwardly between layers 27 and 28 of side flap 23 to at least the terminating end 31 of side flap 23.

In an alternate construction, webbing 30 comprises two separate strips, each of which is securely mounted independently to saddle tree 21 in a conventional manner. The strips then extend, in opposite directions, in secure, mounted engagement with side flaps 22 and 23 to the terminating ends thereof.

Although the preferred embodiment of saddle 20 of the present invention comprises side flaps incorporating two substantially continuous, independent layers 27 and 28, with webbing 30 sandwiched therebetween, the present invention could also be employed with saddle constructions wherein each side flap comprises a single layer, with webbing 30 securely mounted to the layer forming the side flap.

If desired, webbing 30 may comprise any size or shape which is compatible with side flaps 22 and 23 to which the webbing is cooperatingly associated. It has been found, however, that the preferred embodiment for webbing 30 is the use of a substantially continuous, elongated strip of high strength material having an overall width of between about one inch and four inches. In the preferred construction, webbing 30 comprises an elongated, substantially continuous strip of high strength nylon material having a width of about two inches.

In the preferred configuration, a thin layer of foam material is inserted between layers 27 and 28 of side flaps 22 and 23, with the foam material extending from webbing strip 30 forwardly to the edge of the side flaps. In this way, a smooth, outer surface is attained in order to further enhance the rider's comfort.

In the preferred configuration, wherein webbing 30 is sandwiched between out layer 27 and inner layer 28 of side flaps 22 and 23, webbing 30 is securely stitched to flaps 22 and 23 at least along the lower edges of the flaps and adjacent saddle tree 21, in order to assure webbing 30 is securely maintained in the desired position. However, if desired, webbing 30 may be stitched along the length of side flaps 22 and 23, either continuously or in intermediate positions. If desired, adhesive means can be employed instead of stitching to securely fasten webbing 30 to side flaps 22 and 23.

As shown in FIGS. 1, 2 and 3, the preferred embodiment of saddle construction 20 comprises a webbing 30 which incorporates extension portions 32 and 33. Extension portion 32 protrudes beyond terminating edge 29 of side flap 22, while extension portion 33 protrudes beyond terminating edge 31 of side flap 23. In this embodiment, extension portions 32 and 33 of webbing 30 form the terminating ends of webbing 30.

As shown in FIGS. 1, 2 and 3, extension portions 32 and 33 are employed for securely mounting short billet straps 36 directly thereto. Preferably, a pair of billet straps 32 are securely stitched to each of the extension portions. In this way, a saddle construction having all of the inherent strength and integrity of conventional saddle constructions is attained, with all of the advantages present therewith, while completely eliminating the need for sweat flaps, as well as eliminating all of the disadvantages of long billet straps.

By employing the present invention, only short billet straps 36 are required. Since these billet straps are in secure mounted engagement with extension portion 32 and 33 of webbing 30, billet straps 36 can be quickly and easily replaced, whenever required, with simplicity and ease, without requiring any disassembly of any portion of the saddle construction itself.

In the preferred embodiment, top layer 27 of side flaps 22 and 23 incorporates a short extension tab 37 along its lower terminating edge 29 which is in juxtaposed, overlying engagement with extension portion 32 on side flap 22 and extension portion 33 on side flap 23. Although not required for structural integrity, extension tabs 37 are preferred for both aesthetics as well as preventing any unnecessary, undesirable excessive wear along the lower edge of side flaps 22 and 23.

As is readily apparent from the preceding description, the use of webbing 30 eliminates the need for long billet straps and achieves a unique saddle configuration wherein all of the disadvantages of long billet straps are totally eliminated. By employing the saddle construction of the present invention with webbing 30 incorporated therein, a saddle construction is achieved with webbing 30 performing all of the structural functions and securement requirements for which long billet straps are presently used. However, the present invention eliminates all of the undesirable difficulties inherent with saddle constructions incorporating long billet straps, while not compromising any of the advantages achieved therefrom.

It will best be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also be understood that the following claims are intended to cover all of the generic and specific features of the invention herein described, and all statements of the scope of the invention, which as a matter of language, might be said to fall therebetween.

Having described my invention, what I claim as new and desire to secure by Letters Patent is:

1. A saddle construction comprising:

A. a centrally disposed tree portion,

B. two side flaps extending from the tree portion,

C. web means securely attached to the side flaps at a plurality of separate positions along the length thereof, preventing independent movement of the entire web means relative to the side flap; and D. billet straps securely affixed to the terminating ends of the web means whereby a unique saddle construction is achieved which eliminates the need for seat flaps and long billet straps, as well as the twisting, turning, and wear of the billet straps below the side flap.

2. The saddle construction defined in claim 1, wherein each of the side flaps comprises a single, substantially continuous layer.

3. The saddle construction defined in claim 1, wherein each side flap comprises two layers and the web means is securely mounted thereto by being sandwiched between said layers.

4. The saddle construction defined in claim 1, wherein said web means comprises an extension portion on each of said side flaps, said extension portion protruding beyond the terminating edges of the side flaps to provide billetstrap mounting zones.

5. The saddle construction defined in claim 1, wherein the web means is further defined as secured to the side flaps by stitching.

6. The saddle construction defined in claim 1, wherein said web means is further defined as secured to the side flaps by adhesive means.

7. The saddle construction defined in claim 1, wherein the web means comprises an elongated, substantially continuous strip of high strength material securely mounted to the tree portion and extending therefrom along the entire length of the side flaps.

8. The saddle construction defined in claim 7, wherein the high strength material is woven.

9. The saddle construction defined in claim 8, wherein the web means comprises nylon.

10. The saddle construction defined in claim 8, wherein the high strength woven material comprises one selected from the group consisting of nylon, linen, and cotton.

11. A saddle construction comprising

A. a centrally disposed tree portion;

B. two side flaps extending from opposed sides of the tree portion, each of said side flaps being formed by two substantially continuous, independent layers, with each of said layers being substantially equal in area;

C. web means 1. extending from the tree portion,
2. positioned in sandwiched engagement between the layers forming the side flaps, for secure retained engagement therebetween, and securely attached to at least one of said layers along substantially the entire length of the web means, and
3. incorporating extension portions protruding from the terminating ends of the side flaps and establishing billet mounting zones; and D. billet straps securely affixed to the extension portions of the web means.

12. The saddle construction defined in claim 11, wherein the web means comprises two independent elongated strips of high strength material, with each of the strips being secured to the tree portion.

13. The saddle construction defined in claim 11, wherein the web means comprises a single, continuous elongated strip of high strength material extending upwardly along one side flap to the tree portion and down the second side flap.

14. The saddle construction defined in claim 11, wherein said web means comprises an elongated strip having a width between about one inch and four inches.

* * * * *